US007186659B2

(12) United States Patent
Fujimoto et al.

(10) Patent No.: US 7,186,659 B2
(45) Date of Patent: Mar. 6, 2007

(54) PLASMA ETCHING METHOD

(75) Inventors: Kotaro Fujimoto, Kudamatsu (JP); Takeshi Shimada, Hikari (JP)

(73) Assignee: Hitachi High-Technologies Corporation, Tokyo (JP)

( * ) Notice: Subject to any disclaimer, the term of this patent is extended or adjusted under 35 U.S.C. 154(b) by 185 days.

(21) Appl. No.: 11/063,180

(22) Filed: Feb. 23, 2005

(65) Prior Publication Data

US 2006/0086692 A1 Apr. 27, 2006

(30) Foreign Application Priority Data

Oct. 25, 2004 (JP) ..... 2004-309506

(51) Int. Cl.
*H01L 21/302* (2006.01)
*H01L 21/3065* (2006.01)

(52) U.S. Cl. ..... 438/706; 438/710; 438/720; 252/79.1

(58) Field of Classification Search ..... 438/706, 438/710, 720; 252/79.1
See application file for complete search history.

(56) References Cited

U.S. PATENT DOCUMENTS 4,985,113 A * 1/1991 Fujimoto et al. ..... 438/694

FOREIGN PATENT DOCUMENTS

| | | |
|---|---|---|
| EP | 1126514 A2 * | 8/2001 |
| JP | 06-084839 | 3/1994 |
| JP | 06-112169 | 4/1994 |

* cited by examiner

*Primary Examiner*—Nadine Norton
*Assistant Examiner*—Lynette T. Umez-Eronini
(74) *Attorney, Agent, or Firm*—Antonelli, Terry, Stout and Kraus, LLP.

(57) ABSTRACT

The present invention provides a plasma etching method that can etch a metal film as a material to be etched selectively against an organic film underlying the material. The etching method comprising the steps of introducing an etching gas in an etching chamber wherein a material to be etched is placed, and exciting the etching gas to a plasma state to etch that material to be etched, wherein the material to be etched is a metal film 3 consisting of Au, Pt, Ag, Ti, TiN, TiO, Al, an aluminum alloy, or a laminated film of these films laminated on an organic film 5; and the etching gas is a mixed gas containing at least a gas selected from a group consisting of $Cl_2$, $BCl_3$, and HBr; and at least a gas selected from a group consisting of $CH_2Cl_2$, $CH_2Br_2$, $CH_3Cl$, $CH_3Br$, $CH_3F$, and $CH_4$.

8 Claims, 9 Drawing Sheets

PLASMA ETCHING METHOD

The present application is based on and claims priority of Japanese patent application No. 2004-309506 filed on Oct. 25, 2004, the entire contents of which are hereby incorporated by reference.

BACKGROUND OF THE INVENTION

1. Field of the Invention

The present invention relates to an etching method for etching a material to be etched, in other words, a sample, by exciting an etching gas to a plasma state; and specifically, an etching method suitable for selectively etching a sample with respect to an organic material, wherein the underlying substance of the film to be etched is an organic film.

2. Description of the Related Art

Techniques for etching semiconductor devices such as microwave plasma etching, reactive ion etching and the like have been known. In these etching techniques, an etching gas is excited to a plasma state using a radio-frequency electric field by parallel-plate electrodes or cyclotron resonance, and the material is etched. These etching techniques have also been used as techniques for etching a nonvolatile material used in ferroelectric memories. For example, as a method for etching an Al film as the material to be etched, the plasma of a $Cl_2$-based mixed gas containing $BCl_3$ is generally used as the etching gas. As a method for etching an Au film as the material to be etched, as a mixed gas of halogen gases other than a mixed gas of $CF_4$ and $O_2$, or $CF_4$, or an inert gas such as Ar, is used (e.g., refer to Japanese Patent Application Laid-Open No. 6-84839 (patent document 1) and Japanese Patent Application Laid-Open No. 6-112169 (patent document 2).

In the etching of the material to be etched, it is required, as the etching performance, that the material to be etched is selectively etched. Specifically, when a material such as a photoresist film, an oxide film or a nitride film is used as a masking material, it is required that the material to be etched is selectively etched against the masking material. In other words, it is required that there is a large selection ratio between the etching rate of the material to be etched to the etching rate of the masking material. Similarly, it is also required that the material to be etched is selectively etched against the underlying material. In other words, it is required that there is a large selection ratio between the etching rate of the material to be etched to the etching rate of the underlying oxide film.

In etching techniques conventionally used, for example as shown in FIG. 1, when an Al film 3 in a material to be etched is etched using a photoresist film 4 as a mask, wherein an oxide film ($SiO_2$ film) 2 is formed on an Si substrate 1 and the Al film 3 is formed thereon, a $Cl_2$-based mixed gas is used, and plasma is formed from the gas to etch the Al film 3, which is the material to be etched. At this time, the underlying oxide film 2 is also etched because it is similarly exposed to the plasma.

The Al film is etched since aluminum chloride is mainly formed by the reaction with chlorine radicals and chlorine ions formed from the $Cl_2$-based mixed gas. The underlying oxide film exposed to the plasma is also etched since silicon tetrachloride is mainly formed by the reaction with the chlorine radicals and the chlorine ions.

At this time, the bonding energy of an Al—Al bond composing the Al film is 40 kcal/mol, the bond energy of an Al—Cl bond composing aluminum chloride, which is the reaction product, is 118 kcal/mol, the bond energy of an Si—O bond composing the oxide film, which is the underlying substance, is 192 kcal/mol, and the bond energy of an Si—Cl bond composing silicon tetrachloride, which is the reaction product, is 77 kcal/mol. The chemical reaction proceeds when the bond is broken and another bonding form is produced by applying energy larger than the bond energy.

In this case, since the bond energy of the Si—O bond of the oxide film of the underlying material is larger than the bond energies of the Al—Al, Al—Cl and Si—Cl bonds, etching of the Al film proceeds easily than the oxide film. In other words, the etching rate of the Al film is higher than the etching rate of the oxide layer, and the Al film can be selectively etched against the oxide film.

However, if the underlying material is an organic film, it is difficult to etch an Al film, which is a material to be etched, selectively against the organic film. For example, as shown in FIG. 2, in a material to be etched wherein an organic film 5 is formed on an Si substrate 1 and an Al film 3 is formed thereon, when the Al film 3 laminated on an organic film 5, which is an underlying material, is etched using a photoresist film 4 as a mask, the Al film 3 is etched because aluminum chloride is mainly formed by the reaction with chlorine radicals and chlorine ions in plasma formed from $Cl_2$-based mixed gas. Since the underlying organic film 5 is also exposed to the plasma, it is etched because carbon tetrachloride is mainly formed by the reaction with chlorine radicals and chlorine ions. Since the bond energies of the C—C, C—H and C—F bonds composing the organic film 5, which is the underlying material, are 144 kcal/mol, 81 kcal/mol and 107 kcal/mol, respectively, and are smaller than the bond energy of the Si—O bond when the underlying material is an oxide film, which is 192 kcal/mol, the organic film 5 can be easily etched than the oxide film. Specifically, the selection ratio of the Al film against the underlying material is lowered when the underlying material is changed from the oxide film to the organic film. The generally known selection ratio of the Al film against the underlying organic film is a value of 2 or less.

Furthermore, although a halogen gas is generally used for etching nonvolatile material, such as Au and Pt, since the saturated vapor pressure of the reaction product thereof is lower than the saturated vapor pressure of a photoresist, which is the masking material, and an oxide film or an organic film, which is the underlying material, in the etching of a nonvolatile material, it is difficult to selectively etch the photoresist of the masking material and the oxide film or the organic film of the underlying material. The generally known selection ratio of Au or Pt, which is a nonvolatile material, against the underlying oxide film or organic film is 0.2 to 0.8, which is less than 1.

SUMMARY OF THE INVENTION

The object of the present invention is to provide a plasma etching method that can selectively etch gold (Au), platinum (Pt), silver (Ag), titanium (Ti), titanium nitride (TiN), aluminum (Al), aluminum alloys, or the laminated film of these films against an underlying organic film present.

In order to solve the above problems, the present invention provides a method for etching comprising the steps of introducing an etching gas in an etching chamber wherein a material to be etched is placed, and exciting the etching gas to a plasma state to etch said material to be etched, wherein the material to be etched is a metal film laminated on an organic film, and a mixed gas containing at least a gas selected from a group consisting of chlorine ($Cl_2$), boron trichloride ($BCl_3$), and hydrogen bromide (HBr); and at least a gas selected from a group consisting of dichloromethane ($CH_2Cl_2$), dibromomethane ($CH_2Br_2$), chloromethane ($CH_3Cl$), bromomethane ($CH_3Br$), methyl fluoride ($CH_3F$), and methane ($CH_4$) as the etching gas are used.

The present invention also provides a method for etching comprising the steps of introducing an etching gas in an etching chamber wherein a material to be etched is placed, and exciting the etching gas to a plasma state to etch the material to be etched, wherein the material to be etched is a metal film laminated on an organic film, and as the etching gas, a mixed gas containing at least a gas selected from a group consisting of $Cl_2$, $BCl_3$, and HBr; and at least a gas selected from a group consisting of $C_2H_6$, $C_2H_2$, $CH_2Cl_2$, $CH_2Br_2$, $CH_3Cl$, $CH_3Br$, $CH_3F$, and $CH_4$ is used so as to selectively etch the metal film, which is the material to be etched, against the underlying organic film.

The present invention further provides a method for etching comprising the steps of introducing an etching gas in an etching chamber wherein a material to be etched is placed, and exciting the etching gas to a plasma state to etch the material to be etched, wherein the material to be etched is gold (Au), platinum (Pt), silver (Ag), titanium (Ti), titanium nitride (TiN), titanium oxide (TiO), aluminum (Al), an aluminum alloy, or a laminated film thereof; and as the etching gas, a mixed gas containing at least a gas selected from a group consisting of $Cl_2$, $BCl_3$, and HBr; and at least a gas selected from a group consisting of $C_2H_6$, $C_2H_2$, $CH_2Cl_2$, $CH_2Br_2$, $CH_3Cl$, $CH_3Br$, $CH_3F$, and $CH_4$ is used.

The present invention provides a method for etching comprising the steps of introducing an etching gas in an etching chamber wherein a material to be etched is placed, and exciting the etching gas to a plasma state to etch the material to be etched, wherein the material to be etched is gold (Au), platinum (Pt), silver (Ag), titanium (Ti), titanium nitride (TiN), titanium oxide (TiO), aluminum (Al), an aluminum alloy, or a laminated film thereof; and as the etching gas, a mixed gas containing at least a gas selected from a group consisting of $Cl_2$, $BCl_3$, and HBr; and at least a gas selected from a group consisting of $CH_2Cl_2$, $CH_2Br_2$, $CH_3Cl$, $CH_3Br$, $CH_3F$, and $CH_4$ is used so as to selectively etch the metal film, which is the material to be etched, against the underlying organic film.

The present invention provides a method for etching comprising the steps of introducing an etching gas in an etching chamber wherein a material to be etched is placed, and exciting the etching gas to a plasma state to etch the material to be etched, wherein the material to be etched is placed on an electrode that can control the temperature of the material to be etched to 95° C. or below, and is etched in the region of the pressure range between 0.06 Pa and 1.2 Pa.

The present invention provides a method for etching comprising the steps of introducing an etching gas in an etching chamber wherein a material to be etched is placed, and exciting the etching gas to a plasma state to etch the material to be etched, wherein at least a gas selected from a group consisting of argon (Ar), krypton (Kr), and xenon (Xe) is added to the etching gas.

As described above, when a metal film, which is a material to be etched, laminated on an organic film is etched in an etching chamber, the present invention enables to etch the metal film selectively against the underlying organic film. By performing cleaning during the wafer processing in a lot, the state in the chamber can be maintained well.

(Operation)

The use of a mixed gas containing at least a gas selected from a group consisting of $Cl_2$, $BCl_3$, and HBr; and at least a gas selected from a group consisting of $CH_2Cl_2$, $CH_2Br_2$, $CH_3Cl$, $CH_3Br$, $CH_4$, and Ar enables to etch the material to be etched in a predetermined selection ratio of the etching rate against an organic film, which is an underlying material, by controlling the mixing ratio thereof.

DETAILED DESCRIPTION OF THE PREFERRED EMBODIMENTS

The first embodiment of the present invention will be described below with reference to FIGS. 3 to 8.

(First Embodiment)

This embodiment utilizes an etching apparatus which is a sample processing apparatus for etching a sample formed on a semiconductor substrate, which is supplied with a gas for forming plasma, generating gas plasma and etching a metal material formed on the substrate. As the plasma etching apparatus to which the etching method and the cleaning method according to the present invention can be applied, a microwave plasma etching apparatus, an inductively-coupled plasma etching apparatus, a helicon-wave plasma etching apparatus, a dual-frequency activated parallel plate plasma etching apparatus or the like can be adopted.

Figure 1:
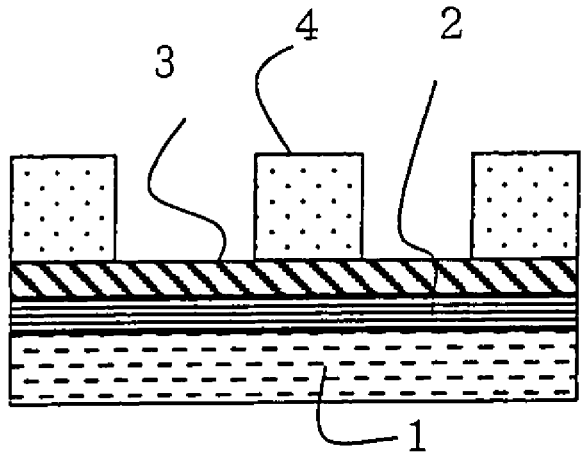
FIG. 1 is a diagram illustrating the structure of the wafer of an aluminum film structure.
Figure 2:
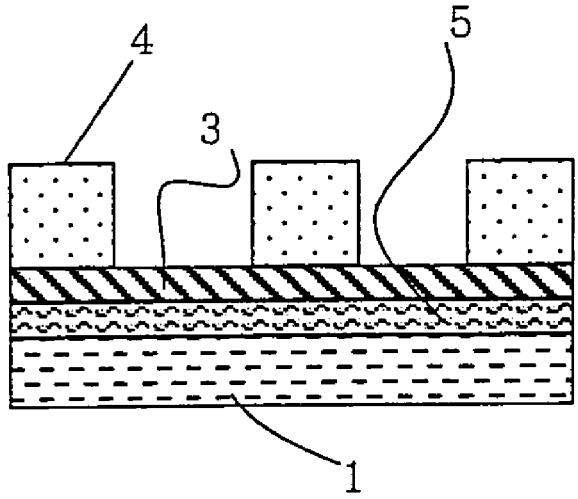
FIG. 2 is a diagram illustrating the structure of the wafer whose underlying material has an organic film structure.
Figure 3:
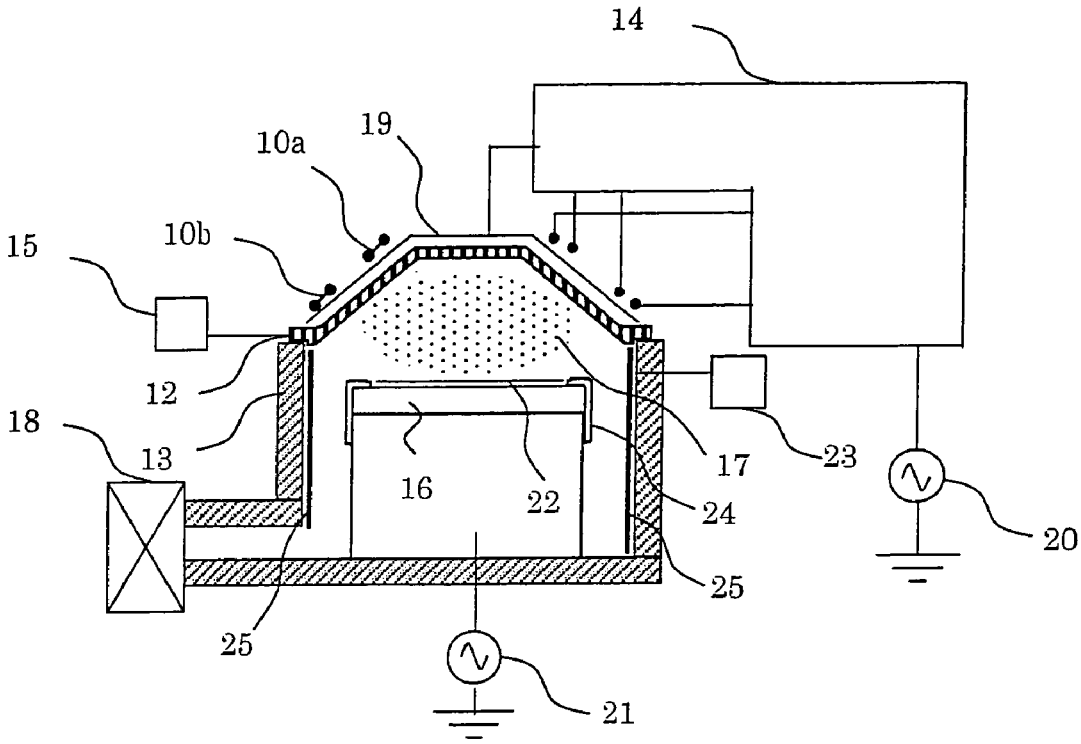
FIG. 3 is a sectional view illustrating the structure of a plasma treatment apparatus to which the first embodiment of the present invention is applied.

The overview of the constitution of the plasma processing apparatus used in the present invention will now be described with reference to FIG. 3. The processing chamber consists of a discharge portion 12 composed of a non-conductive material, such as quartz and ceramics, forming a plasma-generating portion, and a processing portion 13 furnished with an electrode 16 for placing a sample 22 which is the material to be etched. The processing portion 13 is grounded, and the electrode 16 is disposed in the processing portion 13 through an insulator. The discharge portion 12 is furnished with inductively-coupled antennas 10*a* and 10*b*, a matching circuit 14, a first RF source 20 and the like. As a typical example, the first embodiment uses an etching apparatus having a coiled inductively-coupled antenna 10 on the circumference of the discharge portion 12. A processing gas is supplied into the processing chamber from a gas-supply apparatus 15, and at the same time, the pressure thereof is reduced to a predetermined pressure by an exhausting apparatus 18 and the gas is discharged. The processing gas is supplied into the processing chamber from a gas-supply apparatus 15, and plasma is generated from the processing gas by the action of an electric field produced by the inductively-coupled antenna 10. In order to draw ions present in the plasma 17 into the sample 22, a bias voltage is impressed to the electrode 16 from a second RF source 21. Change in the intensity of the light emission of the etching gas emitted by a light-emitting monitoring apparatus 23, or the intensity of the light emission of the reaction product is monitored to determine the endpoint of etching. A faraday shield 19 is installed between the discharge portion 12 and the inductively-coupled antennas 10*a* and 10*b*, a susceptor 24 is installed around the electrode 16, and an inner cover 25 is installed on the inner wall of the processing portion 13.

Figure 4:
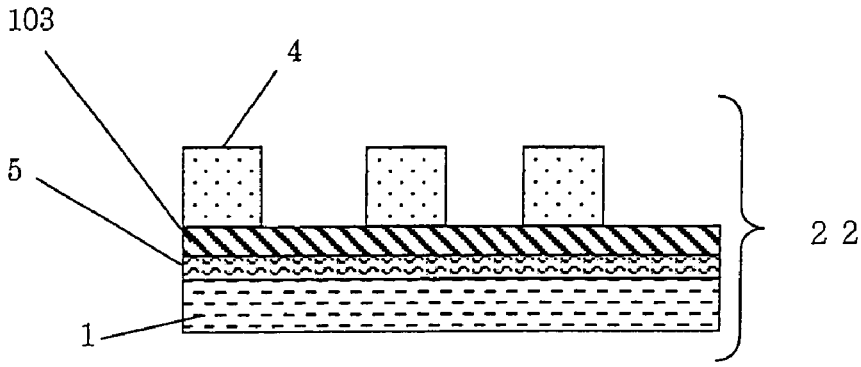
FIG. 4 is a diagram for illustrating the structure of a sample of an Au film used in the first embodiment of the present invention.

Next, the case in which the material to be etched 22 of the structure shown in FIG. 4 is etched using the above-described plasma processing apparatus will be described. In the material to be etched shown in FIG. 4, an organic film 5 is formed on a silicon substrate 1, and an Au film 103, which is the substance to be etched, is formed on the organic film 5. When the Au film 103 is etched using a photoresist film 4 coating the Au film 103, a gas consisting of $Cl_2$ (chlorine) to which Ar (argon) and $CH_2Cl_2$ (dichloromethane) are mixed is used as an etching gas. When the mixed gas is excited to a plasma state, chlorine-based ion species, argon ions, and a hydrocarbon-based ion species produced from $CH_2Cl_2$ can be generated in a ratio corresponding to the mixing ratio.

The above chlorine-based ion species and argon ions exert the etching function to both the Au film and the organic film. On the other hand, the organic matter formed from $CH_2Cl_2$ exerts the function to deposit on the surface of the sample in the same manner as $CH_2Cl_2$ itself, and is deposited on the photoresist 4, the Au film 103 and the organic film 5 lowering the etching rate of each film. However, the present inventors have found that there were conditions wherein the lowering of the etching rate of the organic film 5 against the Au film 103 increased due to the effect of the deposits deposited on the surface of the sample here. Specifically, according to the present invention, a state is realized in which the depositing rate of the organic film 5 is larger than the etching rate, and the etching of the organic film 5 does not proceed, and thus the Au film 103 can be selectively etched against the organic film 5.

The feature of the present invention is that by adding at least a gas selected from the group consisting of $CH_2Cl_2$, $CH_2Br_2$, $CH_3Cl$, $CH_3Br$, $CH_3F$ and $CH_4$, an organic matter can be deposited on the organic film 5, which is the underlying substance, and the material to be etched 103 can be selectively etched against the organic film 5 which is the underlying substance.

Figure 5:
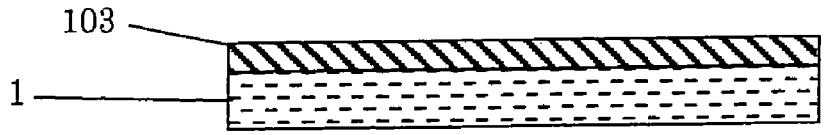
FIG. 5 is a diagram illustrating the structure of a sample for measuring the etching rate of an Au film used for demonstrating the present invention.
Figure 6:
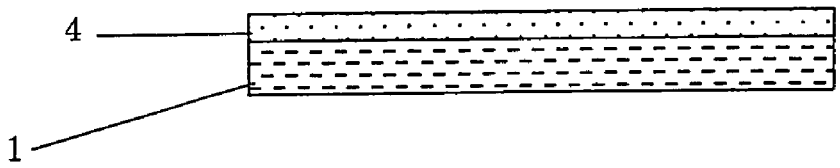
FIG. 6 is a diagram for illustrating the structure of a sample for measuring the etching rate of a photoresist film used for demonstrating the present invention.
Figure 7:
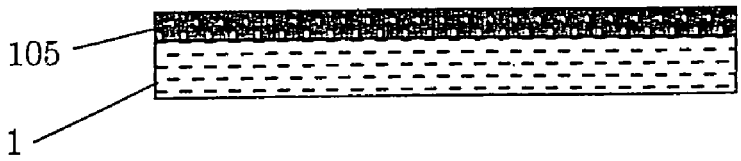
FIG. 7 is a diagram illustrating the structure of a sample for measuring the etching rate of a polyvinylidene fluoride film used for demonstrating the present invention.

In order to measure the etching rate of each film of the sample shown in FIG. 4, the etching rate of the Au film was measured using a wafer for measuring the etching rate of the Au film, wherein an Au film 103 was formed on a silicon substrate 1 of the structure shown in FIG. 5. As the etching rate of organic films, the etching rates of a photoresist film and a polyvinylidene fluoride film were measured as typical films. FIG. 6 shows a wafer structure for measuring the etching rate of the photoresist film, and FIG. 7 shows a wafer structure for measuring the etching rate of the polyvinylidene fluoride film. The wafer for measuring the etching rates of a photoresist film shown in FIG. 6 has a structure in which a photoresist film 4 is formed on the silicon substrate 1, and the wafer structure for measuring the etching rate of the polyvinylidene fluoride film has a structure in which a polyvinylidene fluoride film 105 is formed on the silicon substrate 1. The etching rate was measured under conditions shown in Table 1.

TABLE 1

| | Conditions for measuring the etching rate of each film in the first embodiment | | | | | | | | | |
|---|---|---|---|---|---|---|---|---|---|---|
| Step | $Cl_2$ | Ar | $CH_2Cl_2$ | Pressure | Source RF power | Bias RF power | Faraday shield voltage | Coil current ratio | Electrode temperature | Remarks |
| | ml/min | | | Pa | W | W | V | — | ° C. | |
| 1 | 10 | 60 | 0~30 | 0.3 | 800 | 100 | 900 | 0.8 | 40 | Time etching |

The etching rate of each film was measured using the flow rates of $Cl_2$: 10 ml/min, Ar: 60 ml/min, and $CH_2Cl_2$: 0 to 30 ml/min; a pressure of 0.3 Pa; a source RF power of 800 W;

a bias RF power of 100 W; a faraday shield voltage of 900 V; a coil current ratio of 0.8; and an electrode temperature of 40° C.; and etching was performed for a predetermined time.

Figure 8:
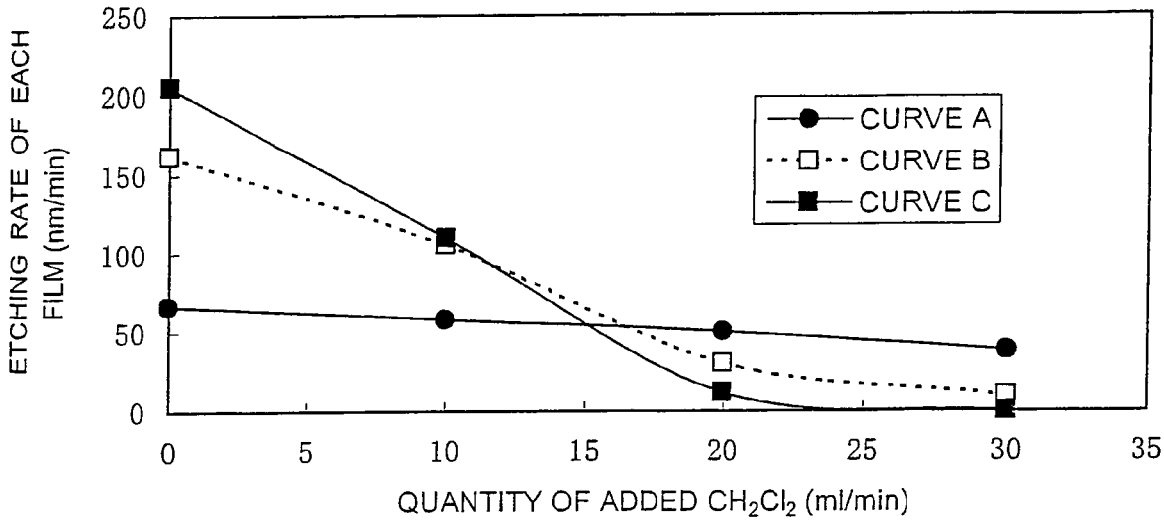
FIG. 8 is a diagram showing the results of measuring the etching rate of each film in the first embodiment of the present invention.
Figure 9:
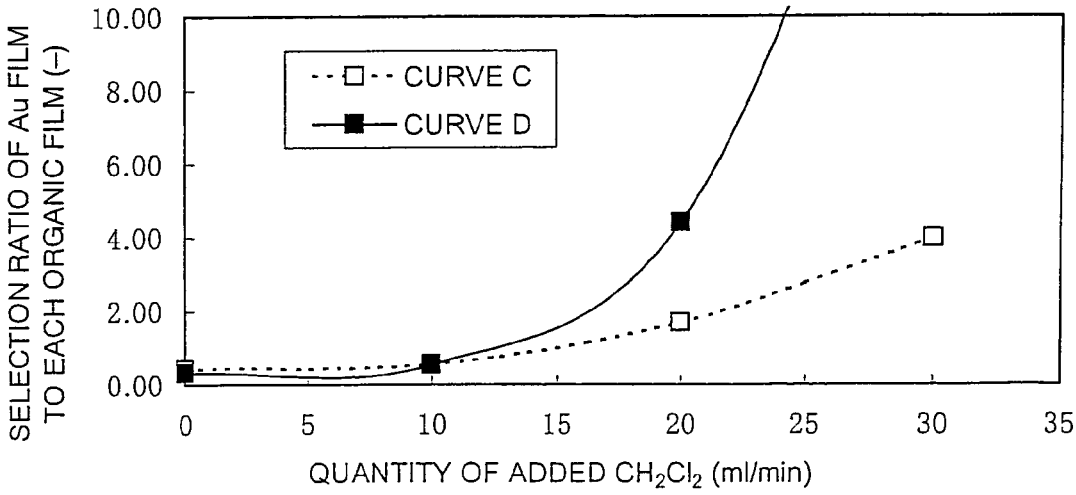
FIG. 9 is a diagram showing the selection ratios calculated from the etching rate of each film in the first embodiment of the present invention.

FIG. 8 shows the composition ratio of $Cl_2/Ar/CH_2Cl_2$-based gas, and the results of the experiment for measuring the etching rate of each film species. In FIG. 8, the curve A plotted with filled circles indicates the etching rate of an Au film measured using the wafer for measuring the etching rate of the Au film when the flow rate of $Cl_2/Ar$ was made constant at 10/60 ml/min, and the flow rate of $CH_2Cl_2$ was varied within the range between 0 and 30 ml/min. The curve B plotted with open squares indicates the etching rate of a photoresist film, which is an organic film, using the wafer for measuring the etching rate of a photoresist film shown in FIG. 6 under the same conditions; and the curve C plotted with filled squares indicates the etching rate of a polyvinylidene fluoride film, which is an organic film, using the wafer for measuring the etching rate of a polyvinylidene fluoride film shown in FIG. 7 under the same conditions. FIG. 9 shows selection ratios calculated from the etching rate of each film species shown in FIG. 8. In FIG. 9, the curve D plotted with open squares indicates the selection ratios of the Au film/photoresist film etching rate, and the curve E plotted with filled squares indicates the selection ratios of the Au film/polyvinylidene fluoride film etching rate.

As is obvious from the results of the experiment, there is a region to greatly lower the etching rate of the photoresist film or the polyvinylidene fluoride film against the etching rate of the Au film depending on the quantity of added $CH_2Cl_2$. Thereby, it was known that the selection ratio of the Au film/photoresist film etching rate and the Au film/polyvinylidene fluoride film etching rate could be significantly increased, and the selection ratio of 1 or more could be obtained. As Table 2 shows, $CH_2Cl_2$ was added to the etching gas in the step for conducting the endpoint determination and the step of over-etching, the wafer shown in FIG. 4 was etched under the conditions wherein the etching rate of the polyvinylidene fluoride film was zero, and 20% over-etching was performed; however, the result was obtained in which polyvinylidene fluoride, which is the underlying substance, was not etched.

TABLE 2

Etching conditions in the first embodiment

| Step | $Cl_2$ | Ar | $CH_2Cl_2$ | Pressure | Source RF power | Bias RF power | Faraday shield voltage | Coil current ratio | Electrode temperature | Endpoint determination |
|---|---|---|---|---|---|---|---|---|---|---|
| | ml/min | | | Pa | W | W | V | — | ° C. | |
| 1 | 10 | 60 | 0 | 0.3 | 800 | 100 | 900 | 0.8 | 40 | Time etching |
| 2 | 10 | 60 | 30 | 0.3 | 800 | 100 | 900 | 0.8 | 40 | Au just + 20% O. E |

Specifically, by using a mixed gas of $Cl_2$ and Ar to which $CH_2Cl_2$ is added as the etching gas, the selection ratio of the Au film and the organic film can be sufficiently increased compared with conventional methods. Although the Au/organic film selection ratio is generally 1.0 or less, a selection ratio of 1.0 or more can be obtained according to the present invention. Although the case of a photoresist and polyvinylidene fluoride is shown in the above embodiment, satisfactory effects can be obtained also for other organic films.

(Second Embodiment)

Figure 10:
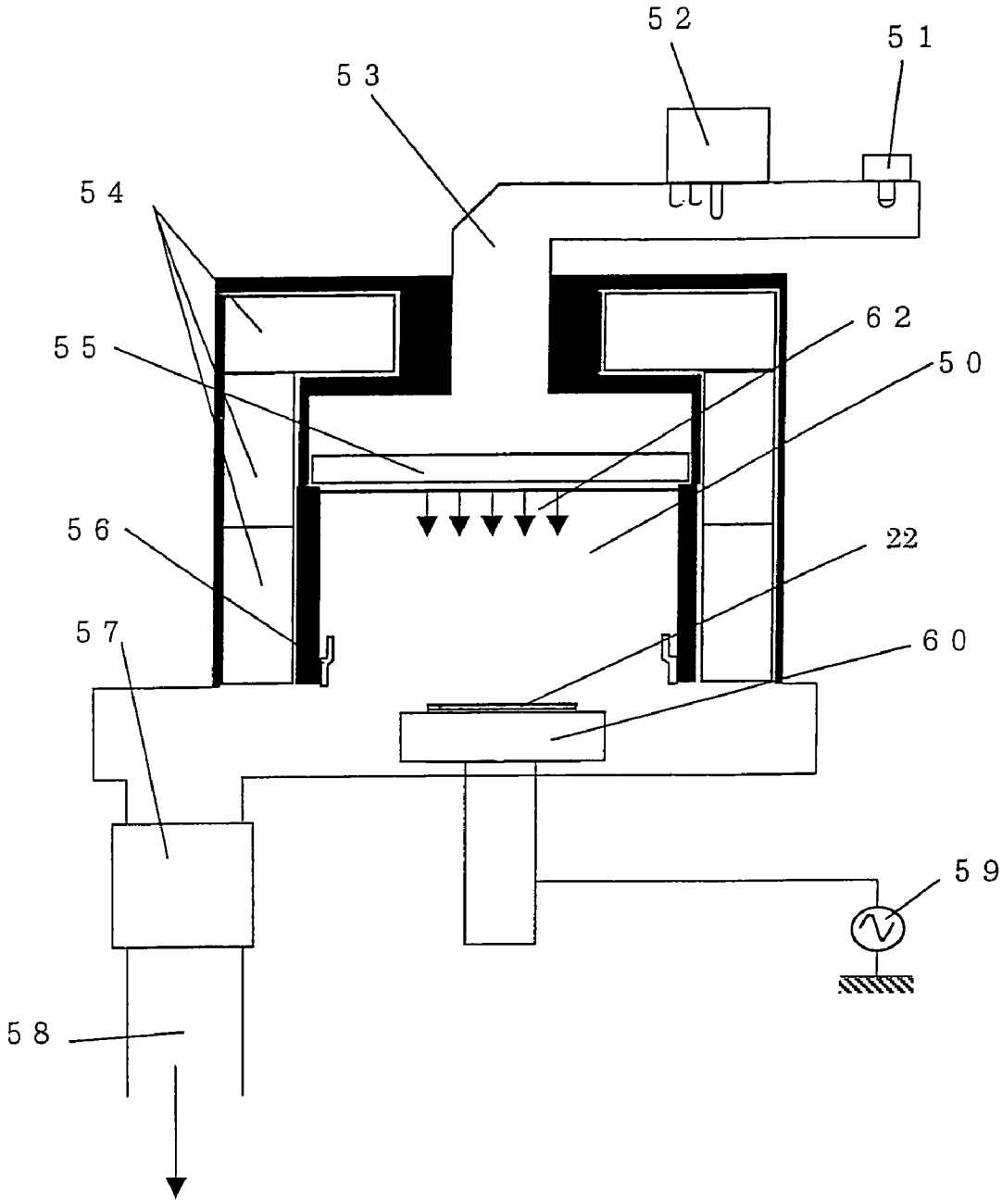
FIG. 10 is a sectional view illustrating the structure of a plasma processing apparatus to which the second and third embodiments of the present invention are applied.

The second embodiment of the present invention will be described below with reference to FIGS. 10 to 14. FIG. 10 shows a microwave plasma etching apparatus for performing the plasma etching of the present invention. In this apparatus, an etching gas 62 is introduced into an etching chamber 50, and microwaves transmitted from a microwave transmitter 51 are conveyed through a matching circuit 52 and a waveguide 53 to the etching chamber 50 from a microwave introducing window 55, to generate plasma from the gas. For high-efficiency discharge, solenoid coils 54 are installed around the etching chamber 50 to produce a magnetic field of 0.0875 tesla, and high-density plasma is generated using electron cyclotron resonance. The etching chamber 50 has an electrode 60, and a material to be processed 22 is placed thereon to etch using the gas plasma. The etching gas 62 introduced in the etching chamber 50 is exhausted out of the etching chamber 50 by an exhaust pump 57 through an exhaust pipe 58. An RF source 59 is connected to the electrode 60 for placing the material to be processed, and a RF bias of 400 kHz to 13.56 MHz can be impressed.

Figure 11:
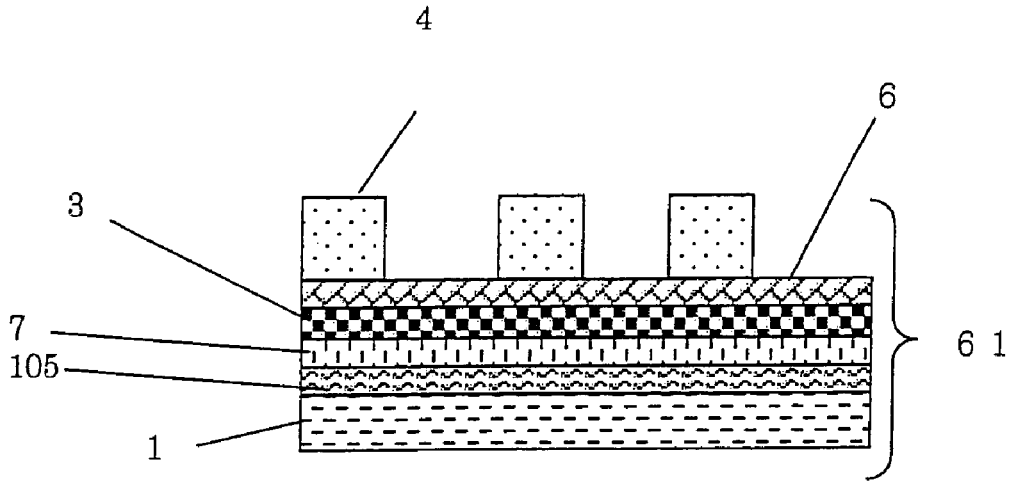
FIG. 11 is a diagram illustrating the structure of the sample of a TiN/Al/TiN laminated film used in the second embodiment of the present invention.

Next, a case will be described in which a sample 61 of a structure shown in FIG. 11 is etched using the above-described microwave plasma etching apparatus. The material to be processed 61 shown in FIG. 11 is a laminated film that has an organic film 105 consisting of polyvinylidene fluoride formed on a silicon substrate 1, and a TiN film 7, an Al film 3 and a TiN film 6, which are materials to be etched, are formed on the organic film 105. When the laminated film is etched using a photoresist film 4 coating the laminated film as a mask, a mixed gas of chlorine ($Cl_2$) and boron-trichloride ($BCl_3$) to which dichloromethane ($CH_2Cl_2$) is added is used. When the mixed gas is excited to plasma state, chlorine-based etching species, and hydrocarbon-based products that can be deposited formed from the photoresist film and $CH_2Cl_2$ can be formed in the ratio corresponding to the mixing ratio.

The chlorine-based etching species exert a function to etch the TiN film 6 and the Al film 3, which are the films composing the laminated film, and the organic film 105, which is the underlying material. At this time, the selection ratio of the TiN film 7 laminated on the organic film 105, which is the underlying material, to the organic film 105, which is the underlying material, is smaller than the selection ratio when the underlying material is an oxide film, because the bonding energy of C—C, C—H or C—F bonds constituting the organic film is smaller than the bonding energy of Si—O bonds constituting the oxide film. The selection ratio of the TiN film 7 to the organic film 105 is generally 2 or below. However, if the quantity of added $CH_2Cl_2$ is increased, there is a region where the lowering of the etching rate of the organic film 105 is larger than the lowering of the etching rate of the TiN film 7, and by performing etching in this region, the TiN film 7 can be selectively etched against the organic film 105, which is the underlying material.

Figure 12:
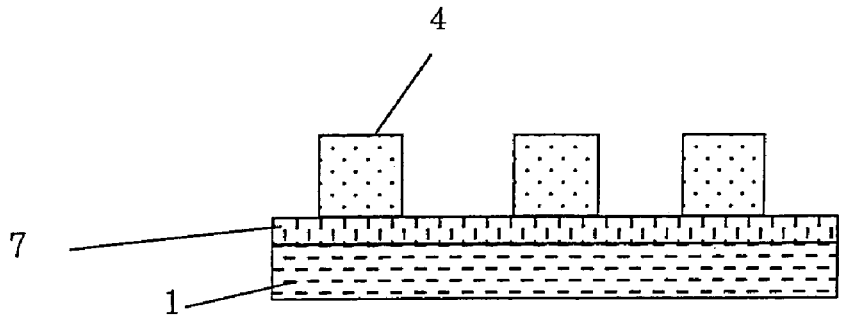
FIG. 12 is a diagram illustrating the structure of a sample for measuring the etching rate of a TiN film for demonstrating the second and third embodiments of the present invention.

In order to measure the etching rate of each film of the sample shown in FIG. 11, the etching rate of the TiN film 7 was measured using a wafer for measuring the etching rate of the TiN film shown in FIG. 12. The wafer for measuring the etching rate of the TiN film is composed of a TiN film 7 formed on the surface of a silicon substrate 1, and a photoresist film 4 for an etching mask is formed on the TiN film 7. As organic films, the etching rates of the photoresist film 4 and the polyvinylidene fluoride film 105 were measured. As the wafer for measuring the etching rate of the photoresist film, the wafer having the structure shown in FIG. 6 was used; and as the wafer for measuring the etching rate of the polyvinylidene fluoride film, the wafer having the structure shown in FIG. 7 was used. The etching rate was measured under the conditions shown in Table 3.

TABLE 3

| | Conditions for measuring the etching rate of each film in the second embodiment | | | | | | | |
|---|---|---|---|---|---|---|---|---|
| Step | $Cl_2$ | $BCl_3$ ml/min | $CH_2Cl_2$ | Pressure Pa | Microwave power W | Bias RF power W | Electrode temperature ° C. | Remarks |
| 1 | 60 | 60 | 0~40 | 0.6 | 600 | 50 | 40 | Time etching |

Specifically, the etching rate of each film was measured using the flow rates of $Cl_2$: 10 ml/min, $BCl_3$: 60 ml/min, and $CH_2Cl_2$: 0 to 40 ml/min; a pressure of 0.6 Pa; a microwave power of 600 W; a bias RF power of 50 W; and an electrode temperature of 40° C.; and etching was performed for a predetermined time.

Figure 13:
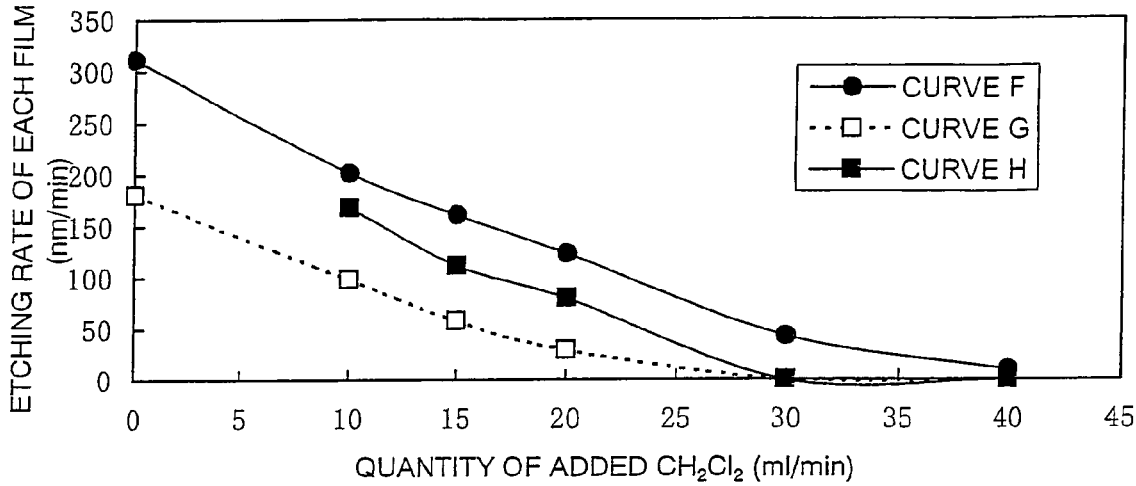
FIG. 13 is a diagram showing the results of measuring the etching rate of each film in the second embodiment of the present invention.
Figure 14:
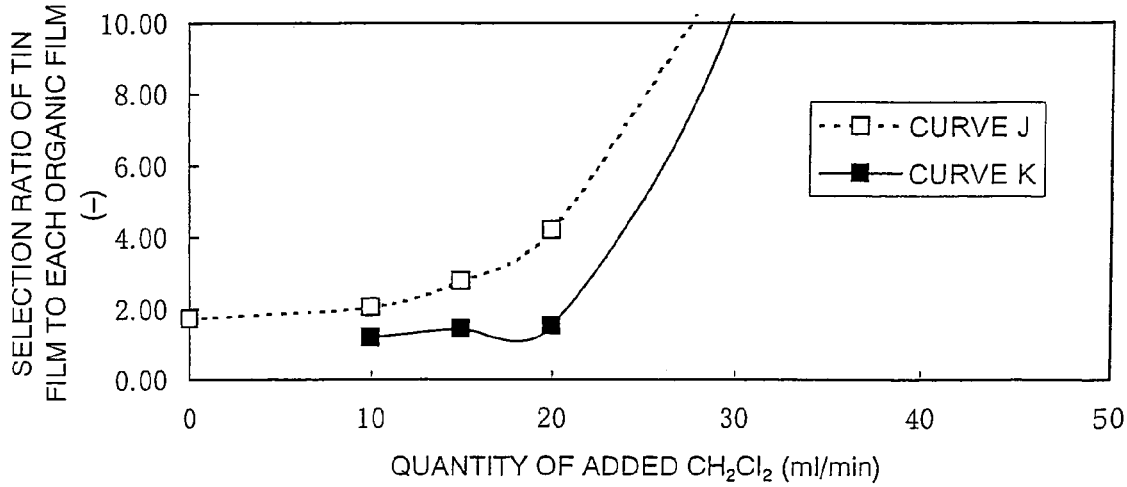
FIG. 14 is a diagram showing the selection ratios calculated from the etching rate of each film in the second embodiment of the present invention.

FIG. 13 shows the composition ratio of $Cl_2/BCl_3/CH_2Cl_2$-based gas, and the results of the experiment for measuring the etching rate of each film species. In FIG. 13, the curve F plotted with filled circles indicates the etching rate of a TiN film when the flow rate of $Cl_2/BCl_3$ was made constant at 60/60 ml/min, and the flow rate of $CH_2Cl_2$ was varied within the range between 0 and 40 ml/min. The curve G plotted with filled squares indicates the etching rate of the photoresist film 4, which is an organic film, and the curve H plotted with open squares indicates the etching rate of the polyvinylidene fluoride film 105, which is also an organic film. FIG. 14 shows selection ratios calculated from the etching rate of each film species shown in FIG. 13. In FIG. 13, the curve J plotted with open squares indicates the selection ratios of the TiN film/photoresist film etching rate, and the curve K plotted with filled squares indicates the selection ratios of the TiN film/polyvinylidene fluoride film etching rate.

As is obvious from the results of the experiment, there is a region to greatly lower the etching rate of the photoresist film 4 or the polyvinylidene fluoride film 105 against the etching rate of the TiN film 7 depending on the quantity of added $CH_2Cl_2$. Thereby, it was known that the selection ratio of the TiN film/photoresist film etching rate and the TiN film/polyvinylidene fluoride film etching rate could be significantly increased, and the selection ratio of 2 or more could be obtained. As Table 4 shows, $CH_2Cl_2$ was added to the etching gas in the step for conducting the endpoint determination and the step of over-etching, the wafer for measuring the etching rate of the TiN film shown in FIG. 11 was etched under the conditions in which the etching rate of the polyvinylidene fluoride film was zero; however, in spite of over-etching, the result was obtained in which the quantity of the etched polyvinylidene fluoride was 5 nm or less.

TABLE 4

| | Etching conditions in the second embodiment | | | | | | | |
|---|---|---|---|---|---|---|---|---|
| Step | $Cl_2$ | $BCl_3$ ml/min | $CH_2Cl_2$ | Pressure Pa | Microwave power W | Bias RF power W | Electrode temperature ° C. | Endpoint determination |
| 1 | 60 | 60 | 10 | 0.6 | 600 | 100 | 40 | Time etching |
| 2 | 60 | 60 | 30 | 0.6 | 600 | 50 | 40 | Au just + 13 s O. E |

(Third Embodiment)

The third embodiment of the present invention will be described below with reference to FIG. 15. There is shown an example in which a sample 61 of a structure shown in FIG. 11 is etched using a mixed gas of chlorine ($Cl_2$) and boron trichloride ($BCl_3$) to which fluoromethane ($CH_3F$) is mixed. The etching rate is measured under the conditions shown in Table 5. The etching rate of the TiN film is measured using a wafer for measuring the etching rate of the TiN film shown in FIG. 12, and the etching rate of the photoresist film is measured using a wafer for measuring the etching rate of the photoresist film shown in FIG. 6.

TABLE 5

| | Conditions for measuring the etching rate of each film in the third embodiment | | | | | | | |
|---|---|---|---|---|---|---|---|---|
| Step | $Cl_2$ | $BCl_3$ ml/min | $CH_3F$ | Pressure Pa | Microwave power W | Bias RF power W | Electrode temperature ° C. | Remarks |
| 1 | 60 | 60 | 0~30 | 0.6 | 600 | 50 | 40 | Time etching |

Figure 15:
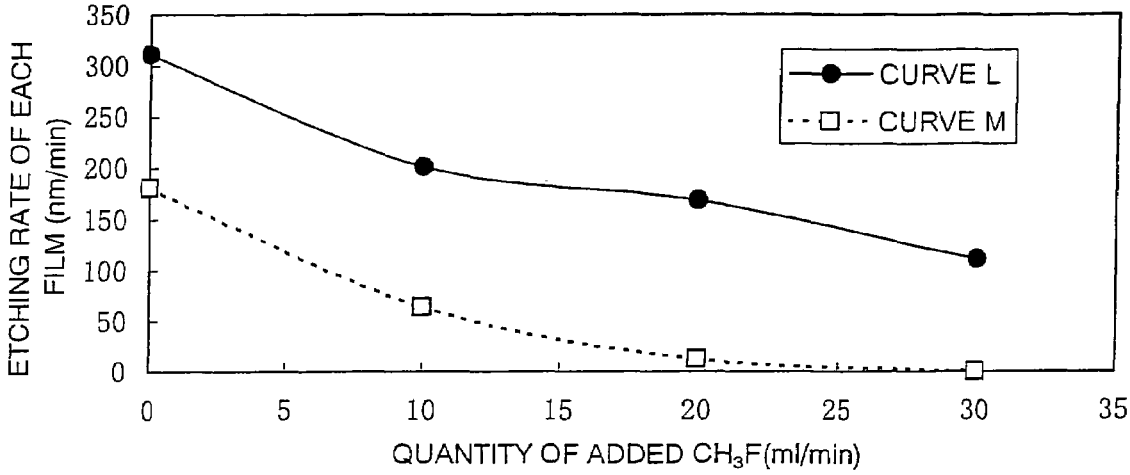
FIG. 15 is a diagram showing the results of measuring the etching rate and the selection ratios of each film in the third embodiment of the present invention.

FIG. 15 shows the composition ratio of $Cl_2/BCl_3/CH_3F$-based gas, and the results of the experiment for measuring the etching rate of each film species. In FIG. 15, the curve L plotted with filled circles indicates the etching rate of a TiN film when the flow rate of $Cl_2/BCl_3$ was made constant at 60/60 ml/min, and the flow rate of $CH_3F$ was varied within the range between 0 and 30 ml/min. The curve M plotted with open squares indicates the etching rate of the photoresist film, which is an organic film.

As is obvious from the results of the experiment, there is a region to greatly lower the etching rate of the photoresist film against the etching rate of the TiN film depending on the quantity of added $CH_3F$. Thereby, it was known that the selection ratio of the TiN film/photoresist film etching rate could be significantly increased, and the selection ratio of 2 or more could be obtained.

(Fourth Embodiment)

The fourth embodiment of the present invention will be described below referring to FIGS. 16 and 17. Using a plasma processing apparatus shown in FIG. 3, the etching rate of the Au film was measured with a wafer for measuring the etching rate of the Au film shown in FIG. 5, and the etching rate of the photoresist film was measured with a wafer for measuring the etching rate of the photoresist film shown in FIG. 6. The etching rate of each film was measure under the condition shown in Table 6 below.

TABLE 6

| | Conditions for measuring the etching rate of each film in the fourth embodiment | | | | | | | | | |
|---|---|---|---|---|---|---|---|---|---|---|
| Step | $Cl_2$ | Ar ml/min | $CH_2Cl_2$ | Pressure Pa | Source RF power W | Bias RF power W | Faraday shield voltage V | Coil current ratio — | Electrode temperature ° C. | Remarks |
| 1 | 8 | 52 | 15 | 0.06~2.0 | 600 | 100 | 500 | 0.8 | 40 | Time etching |

The etching rate of each film was measured using etching gas with flow rates of $Cl_2$: 8 ml/min, Ar: 52 ml/min, and $CH_2Cl_2$: 15 ml/min; a pressure of 0.06 Pa; a source RF power of 600 W; a bias RF power of 100 W; a faraday shield voltage of 500 V; a coil current ratio of 0.8; and an electrode temperature of 40° C.; and etching was performed for a predetermined time.

Figure 16:
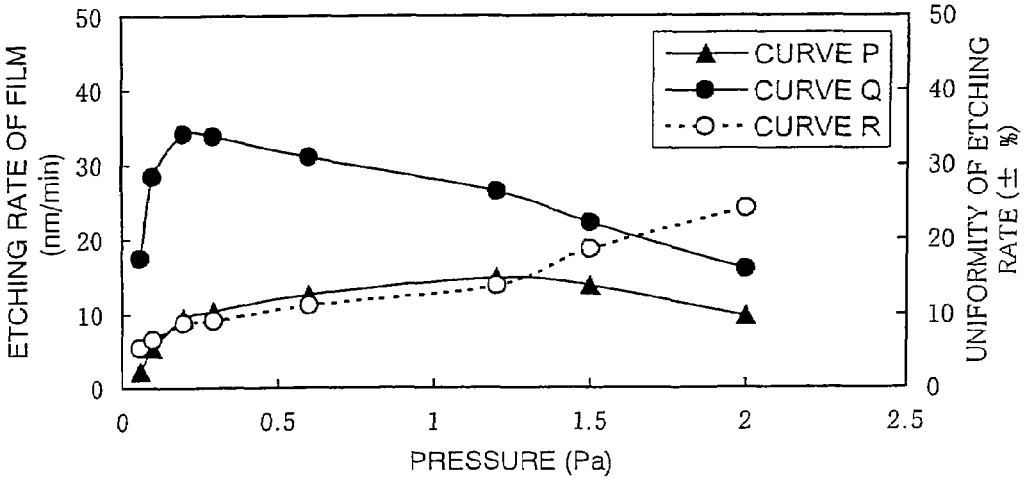
FIG. 16 is a diagram showing the results of measuring the etching rate of each film in the fourth embodiment of the present invention.
Figure 17:
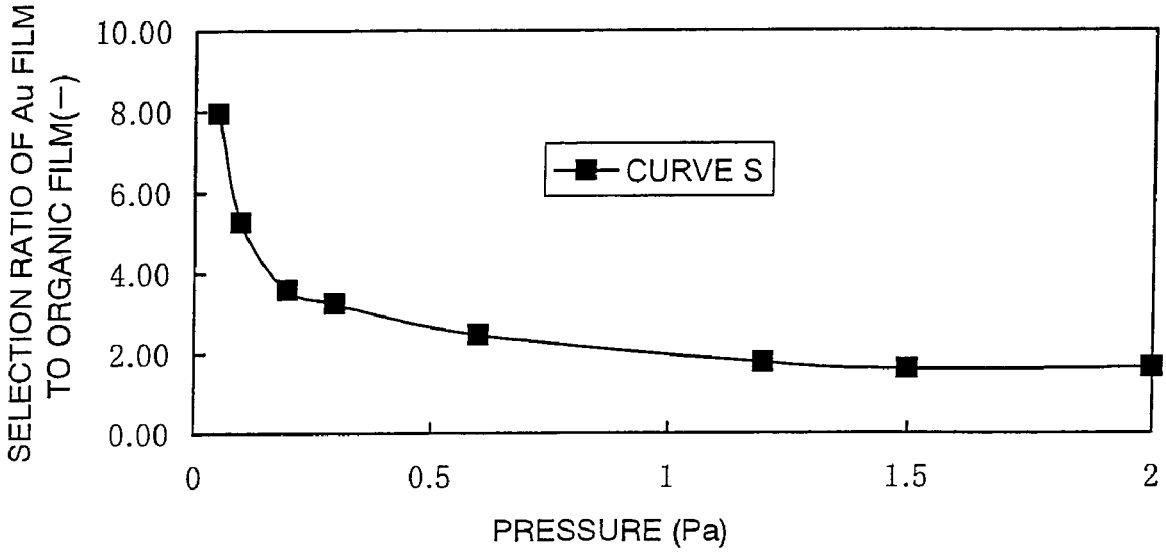
FIG. 17 is a diagram showing the selection ratios calculated from the etching rate of each film in the fourth embodiment of the present invention.

FIG. 16 shows the composition ratio of $Cl_2/BCl_3/CH_2Cl_2$-based gas, and the results of the experiment for measuring the etching rate of each film species. In FIG. 16, the curve P plotted with filled circles indicates the etching rate of an Au film when the pressure was varied from 0.06 to 2.0 Pa. The curve R plotted with open circles indicates the uniformity of the etching rate of the Au film. The curve Q plotted with filled triangles indicates the etching rate of the photoresist film. FIG. 17 shows selection ratios calculated from the etching rate of each film species shown in FIG. 16. In FIG. 17, the curve S plotted with filled squares indicates the selection ratios of the Au film/photoresist film etching rate.

As is obvious from the experiment, it was known that the selection ratio of the etching rate of Au/photoresist film was high in the low-pressure region. The result wherein the uniformity of the Au film is sharply worsened to a value of ±15% or more was obtained from the time when the pressure exceeded 1.2 Pa. Therefore, the selection ratio of the etching rate of Au/photoresist film of 2 or more can be obtained, and the region where the uniformity of the etching rate is not worsened is the region where the pressure is 1.2 Pa or lower. In addition, the result wherein the etching rate of the Au film lowered although a high selection ratio of the Au film/photoresist film etching rate of could be obtained even under a pressure of 0.06 Pa was obtained.

According to the present invention, the same effect can also be obtained by adding at least a gas selected from the group consisting of argon (Ar), krypton (Kr) and xenon (Xe) to the etching gas.

In the above description, although the present invention is described about the method for etching a metal film formed on an organic film, the etching method of the present invention can also be used for cleaning a plasma processing apparatus. Specifically, by in-situ application of the etching method according to the present invention, treatment aiming at the cleaning of a plasma processing apparatus can be performed. More specifically, a plasma processing apparatus can be cleaned by introducing a mixed gas of at least a gas selected from the group consisting of $Cl_2$, $BCl_3$ and Ar, and at least a gas selected from the group consisting of $O_2$ and $CF_4$ in an etching chamber wherein a material to be etched is placed for every lot or every wafer in the lot; and by exciting the cleaning gas to a plasma state.

The above-described cleaning process includes a step for using a cleaning gas consisting of $Cl_2$, to which at least a gas selected from the group consisting of $O_2$ and $CF_4$ is mixed; and a step for plasma treatment using a mixed gas consisting of $Cl_2$, to which at least a gas selected from the group consisting of Ar and $BCl_3$ is added. As the cleaning gas, it is possible to use gas consisting of at least $Cl_2$, to which at least a gas selected from the group consisting of $O_2$, $CF_4$ and Ar is added. The present invention can be accomplished even if the above-described sequence of the steps is reversed, and the effect of the present invention is not influenced by the sequence of the steps.

In other words, the present invention is a cleaning method characterized in that plasma cleaning aiming at in-situ cleaning during wafer processing is performed for every lot or every wafer in the lot, including a step using a mixed gas of at least a gas selected from the group consisting of $O_2$ and $CF_4$, and Ar as the cleaning gas; a step using a mixed gas of $Cl_2$ to which at least a gas selected from the group consisting of Ar and $BCl_3$ is added; and a step using a mixed gas containing $Cl_2$ and at least a gas selected from the group consisting of $O_2$, $CF_4$ and Ar as the cleaning gas. The present invention can be accomplished even if the above-described sequence of the steps is reversed, and the effect of the present invention is not influenced by the sequence of the steps.

The feature of the present invention is that a hydrocarbon-based organic matter is deposited on an organic film, which is an underlying material, using an etching gas to which at least a gas selected from the group consisting of $CH_2Cl_2$, $CH_2Br_2$, $CH_3Cl$, $CH_3Br$, $CH_3F$ and $CH_4$ is added, and that the film to be etched can be etched selectively against the organic film, which is an underlying material.

The present invention is not limited to the above-described embodiments, but various modifications can be made. For example, the Au film or TiN film as a material to be etched can be a Pt film, Ti film or TiO film. In the case of using these films, the Pt film, Ti film or TiO film can be etched selectively against the organic film, which is an underlying material.

What is claimed is:

1. An etching method comprising the steps of introducing an etching gas in an etching chamber wherein a material to be etched is placed, and exciting the etching gas to a plasma state to etch the material to be etched, wherein the material to be etched is a metal film laminated on an organic film, and the etching gas is a mixed gas containing at least a gas selected from a group consisting of chlorine ($Cl_2$), boron trichloride ($BCl_3$), and hydrogen bromide (HBr); and at least a gas selected from a group consisting of dichloromethane ($CH_2Cl_2$), dibromomethane ($CH_2Br_2$), chloromethane ($CH_3Cl$), bromomethane ($CH_3Br$), methyl fluoride ($CH_3F$), and methane ($CH_4$).

2. The etching method according to claim 1, wherein said material to be etched is gold (Au), platinum (Pt), silver (Ag), titanium (Ti), titanium nitride (TiN), titanium oxide (TiO), aluminum (Al), an aluminum alloy, or a laminated film thereof.

3. An etching method comprising the steps of introducing an etching gas in an etching chamber wherein a material to be etched is placed, and exciting the etching gas to a plasma state to etch the material to be etched, wherein the material to be etched is a metal film laminated on an organic film, and the metal film, which is the material to be etched, is selectively etched against the underlying organic film using the etching gas, which is a mixed gas containing at least a gas selected from a group consisting of $Cl_2$, $BCl_3$, and HBr;

and at least a gas selected from a group consisting of $CH_4$, $CH_2Cl_2$, $CH_2Br_2$, $CH_3Cl$, $CH_3Br$, and $CH_3F$.

4. The etching method according to claim 3, wherein the material to be etched is gold (Au), platinum (Pt), silver (Ag), titanium (Ti), titanium nitride (TiN), titanium oxide (TiO), aluminum (Al), an aluminum alloy, or a laminated film thereof.

5. The etching method according to claim 1 or claim 3, wherein the material to be etched is placed on an electrode that can control the temperature of the material to be etched to 95° C. or below, and is etched in the region of the pressure range between 0.06 Pa and 1.2 Pa.

6. The etching method according to claim 1 or claim 3, wherein at least a gas selected from a group consisting of argon (Ar), krypton (Kr), and xenon (Xe) is added to the etching gas.

7. An etching method comprising the steps of introducing an etching gas in an etching chamber wherein a material to be etched is placed, and exciting the etching gas to a plasma state to etch the material to be etched, wherein the material to be etched is a metal film laminated on an organic film, and the etching gas is a mixed gas containing at least a gas selected from a group consisting of chlorine ($Cl_2$), boron trichloride ($BCl_3$), and hydrogen bromide (HBr); and a gas forming a compound that can be deposited by plasma treatment.

8. The etching method according to claim 7, wherein the compound that can be deposited is an organic material ($CH_X$), and the gas forming a compound that can be deposited by plasma treatment is at least a gas selected from a group consisting of dichloromethane ($CH_2Cl_2$), dibromomethane ($CH_2Br_2$), chloromethane ($CH_3Cl_2$), bromomethane ($CH_3Br$), methyl fluoride ($CH_3F$), and methane ($CH_4$).

* * * * *